US005979435A

United States Patent [19]

Puett, Jr.

[11] Patent Number: 5,979,435

[45] Date of Patent: Nov. 9, 1999

[54] METHOD AND APPARATUS FOR HEATING A LIQUID MEDIUM

[75] Inventor: Edwin E. Puett, Jr., Stuart, Fla.

[73] Assignee: Anser Thermal Technologies, Inc., Stuart, Fla.

[21] Appl. No.: 09/044,000

[22] PCT Filed: Sep. 30, 1996

[86] PCT No.: PCT/US96/15157

§ 371 Date: Apr. 2, 1998

§ 102(e) Date: Apr. 2, 1998

[87] PCT Pub. No.: WO97/13103

PCT Pub. Date: Apr. 10, 1997

Related U.S. Application Data

[63] Continuation-in-part of application No. 08/538,339, Oct. 3, 1995, Pat. No. 5,709,201.

[51] Int. Cl.[6] ..... F24C 9/00

[52] U.S. Cl. ..... 126/247; 122/126

[58] Field of Search ..... 126/247; 122/126

[56] References Cited

U.S. PATENT DOCUMENTS

| | | | |
|---|---|---|---|
| 4,060,194 | 11/1977 | Lutz | 126/247 |
| 4,264,826 | 4/1981 | Ullmann | 126/247 |
| 4,352,455 | 10/1982 | Moser et al. | 126/247 |
| 4,357,931 | 11/1982 | Wolpert et al. | 126/247 |
| 4,370,956 | 2/1983 | Moser et al. | 126/247 |
| 4,420,114 | 12/1983 | Moser et al. | 126/247 |
| 4,434,934 | 3/1984 | Moser et al. | 126/247 |
| 4,685,443 | 8/1987 | McMurtry . | |
| 4,926,904 | 5/1990 | Polk et al. | 126/247 |
| 5,188,090 | 2/1993 | Griggs . | |
| 5,385,298 | 1/1995 | Griggs . | |

*Primary Examiner*—Noah Kamen
*Attorney, Agent, or Firm*—Everett G. Diederiks, Jr.

[57] ABSTRACT

A heating apparatus (2) draws in a liquid medium through a motor (7) driven, high pressure pump (5, 172), the liquid medium is greatly increased in pressure and temperature through frictional heating thereof and then the liquid medium is discharged in a heated, reduced pressure state for use directly or for heat exchange with another fluid. A method of utilizing the heating apparatus is also disclosed.

16 Claims, 4 Drawing Sheets

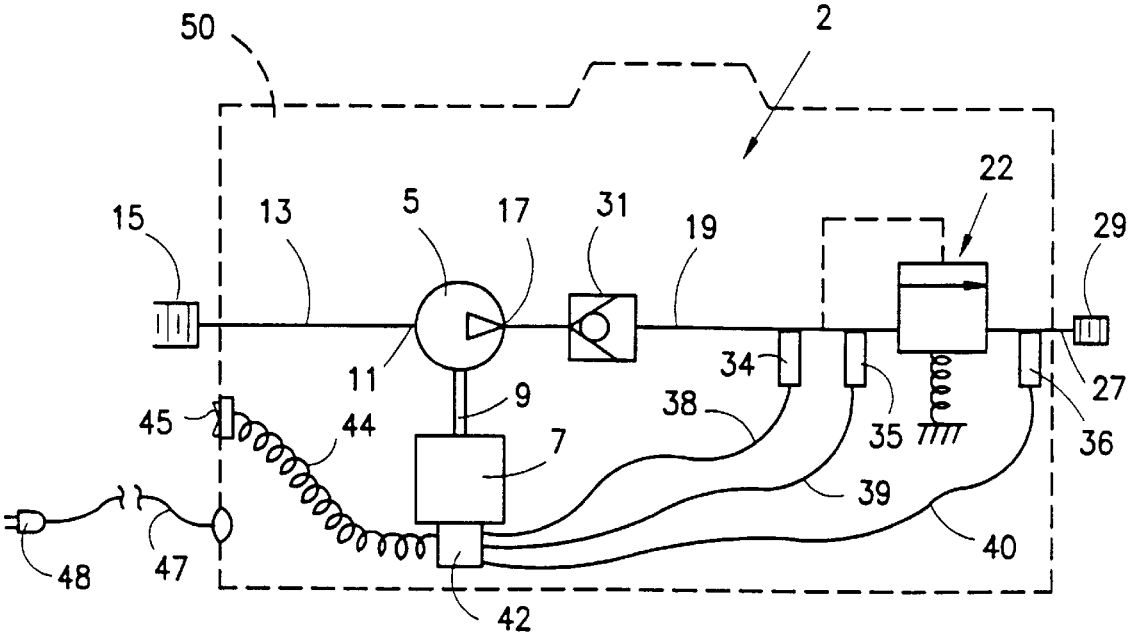
FIG. 1
FIG. 2
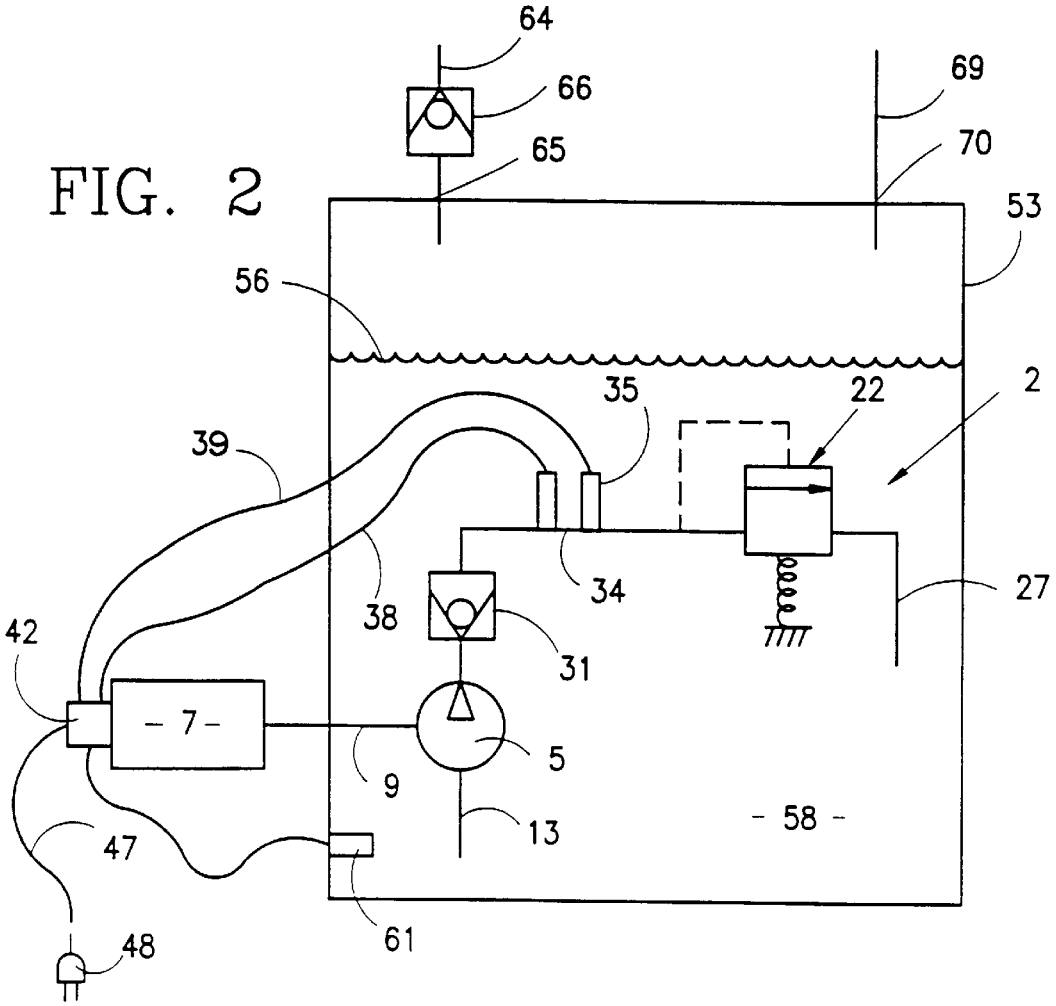

FIG. 7
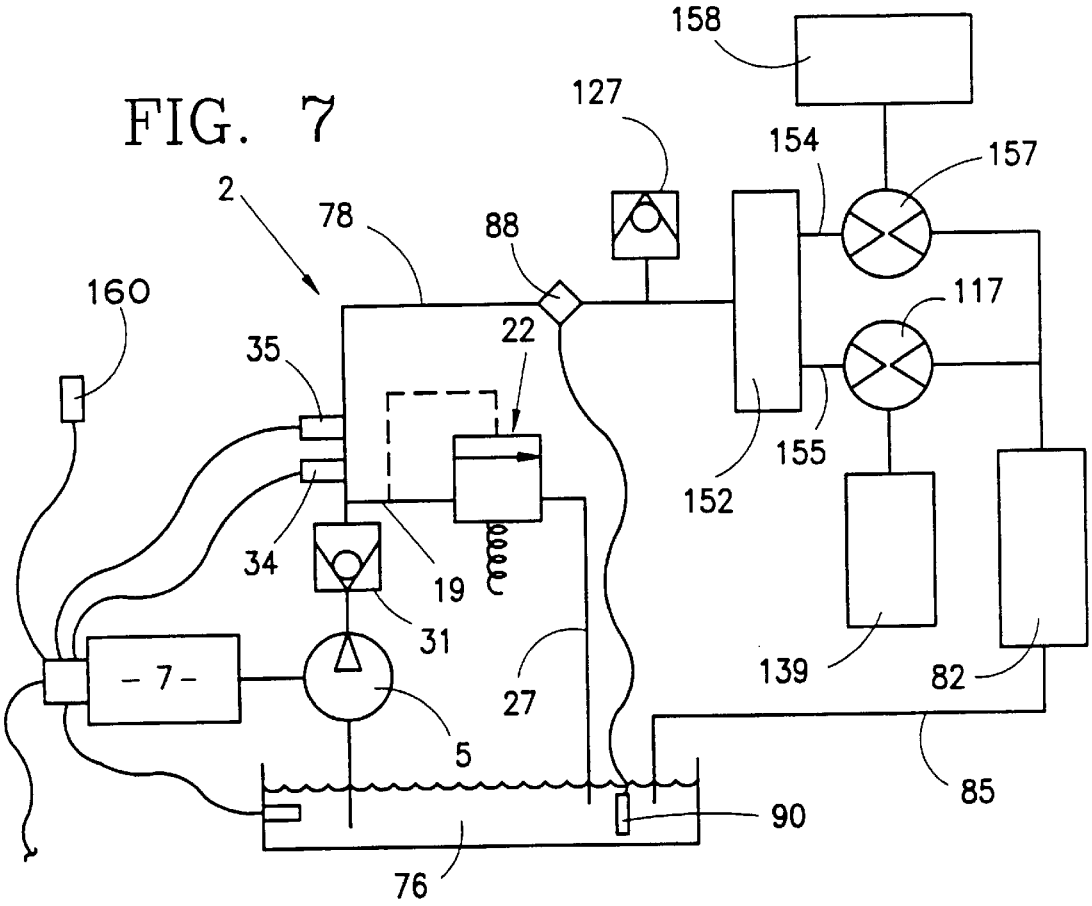
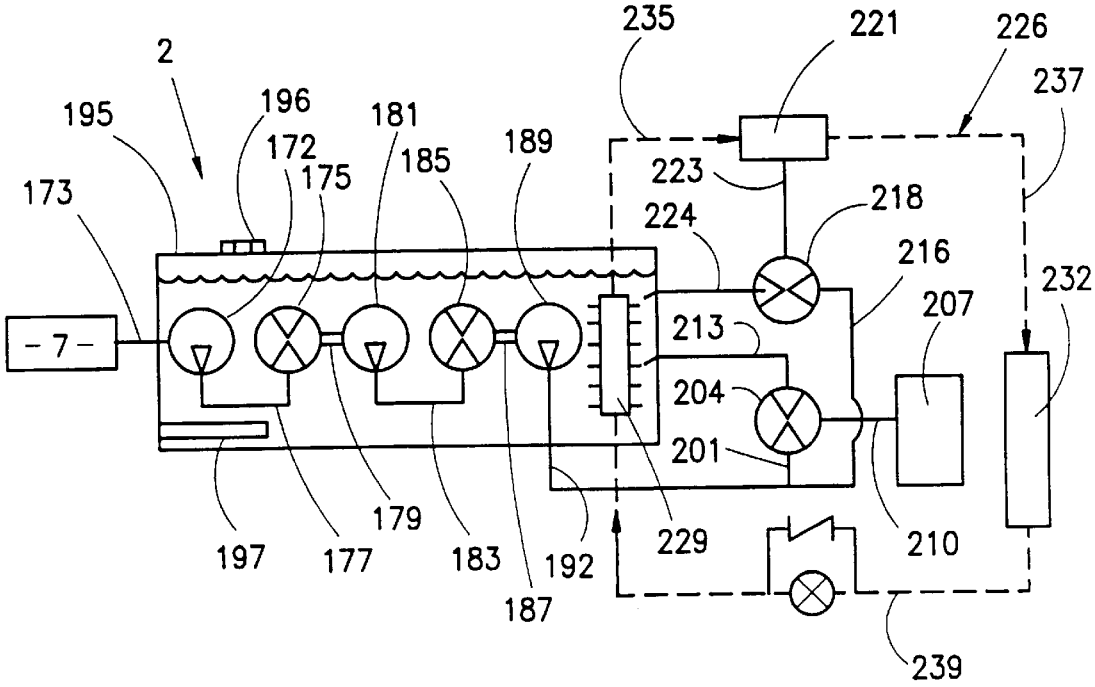
FIG. 8

METHOD AND APPARATUS FOR HEATING A LIQUID MEDIUM

This application is a continuation-in-part of prior U.S. patent application Ser. No. 08/538,339, filed Oct. 3, 1995, now U.S. Pat. No. 5,709,201.

BACKGROUND OF THE INVENTION

1. Field of the Invention

The present invention pertains to an apparatus for generating heat through the use of friction for the purpose of heating a liquid medium, as well as a method for heating a liquid medium.

2. Discussion of the Prior Art

There are an abundance of applications that require the generation and transferring of heat. For example, to name just a few, systems for heating buildings, clothes dryers and water heating units require the generation of heat to warm a fluid medium generally constituted by water or air. Such known arrangements utilize various types of heat sources. For instance, the use of electrical is resistance elements, oil and various type of gas burners are widely known.

Electrical resistance elements are rather inexpensive, can develop high temperatures in rather short time periods and can be readily supplied with electrical operating power. However, such resistance elements have high power consumption rates and are therefore quite costly to operate as compared to other available heating arrangements. Oil and gas burner units can be more cost effective to operate than electrical resistance based units, but oil and gas burner units also have their drawbacks such as limitations based on availability of the respective combustible fluids in particular localities, the potential for operating cost fluxuations based on various global factors and the bulkiness of the overall units.

Based simply on the above, it should be readily apparent that each of the commonly known heating arrangements has its associated advantages and disadvantages. In general, operational efficiencies must be compromised if operational costs are to be minimized. Furthermore, the overall compactness of prior art units represents a significant limitation. Therefore, there exists a need in the art for a compact fluid heating apparatus which is both cost and operationally efficient, while being readily adaptable for various uses in today's marketplace.

SUMMARY OF THE INVENTION

The method and apparatus for heating a liquid medium in accordance with the present invention is based upon the concept of utilizing the heat generated through frictional forces acting on the liquid medium. According to the invention, a fluid medium is drawn into a motor driven, high pressure pump at an initial pressure. The pressure of the liquid medium is greatly increased, generally in the range of fifteen to one hundred-fifty times the initial pressure, and its temperature substantially increased due to frictional forces acting thereon as it is retained in a confined volume defined between the pump and a pressure relieving unit. The liquid medium is permitted to pass through the pressure relieving unit which greatly reduces the pressure of the liquid medium while further heating the liquid medium by means of the frictional forces acting between the liquid medium and the pressure relieving unit.

The heated medium can be constituted by various liquids and can be used for various purposes. For example, in the simplest form of the invention, the liquid medium would constitute water which would simply be heated to various degrees depending on a desired output temperature with the temperature being readily varied, for instance, depending upon the pressure rise/reduction range utilized. Since only a motor, pump and pressure relief unit are required, the apparatus can be made quite compact and mobile. Such an apparatus can have various beneficial uses, for instance as a portable heating supply that can be readily hooked-up to a standard garden hose to provide for a constant supply of heated water such as for washing vehicles or the like, to replace a standard hot water heater in a home and in a pool heating system.

The heated liquid medium may also be used to heat another liquid medium. For example, after being heated, the liquid medium could be directed through a heat exchanger for use in heating another medium. Such an arrangement would also have numerous applications from a building heating system wherein the heat from the heated liquid is conducted to another medium such as air which is then blown into desired heating areas, to a home hot water system that incorporates a storage tank, to a clothes dryer and a boiler to name a few. In these applications, the preferred liquid medium is hydraulic fluid and is designed to replace conventional liquid heating arrangements while representing a more compact and energy efficient system.

Additional features and advantages of the invention will become more readily apparent from the following detailed description thereof when taken in conjunction with the following drawings which show the versatility of the invention by illustrating the same for use in various environments.

BRIEF DESCRIPTION OF THE DRAWINGS

FIG. 1 schematically illustrates the liquid heating apparatus of the invention in accordance with a first embodiment thereof.

FIG. 2 is a schematic of the heating apparatus illustrated for use in a boiler.

FIG. 7 is a schematic of the heating apparatus of the invention incorporated in a clothes dryer.

FIG. 8 is a schematic of another embodiment of the heating apparatus of the invention.

DETAILED DESCRIPTION OF THE PREFERRED EMBODIMENTS

Figure 3:
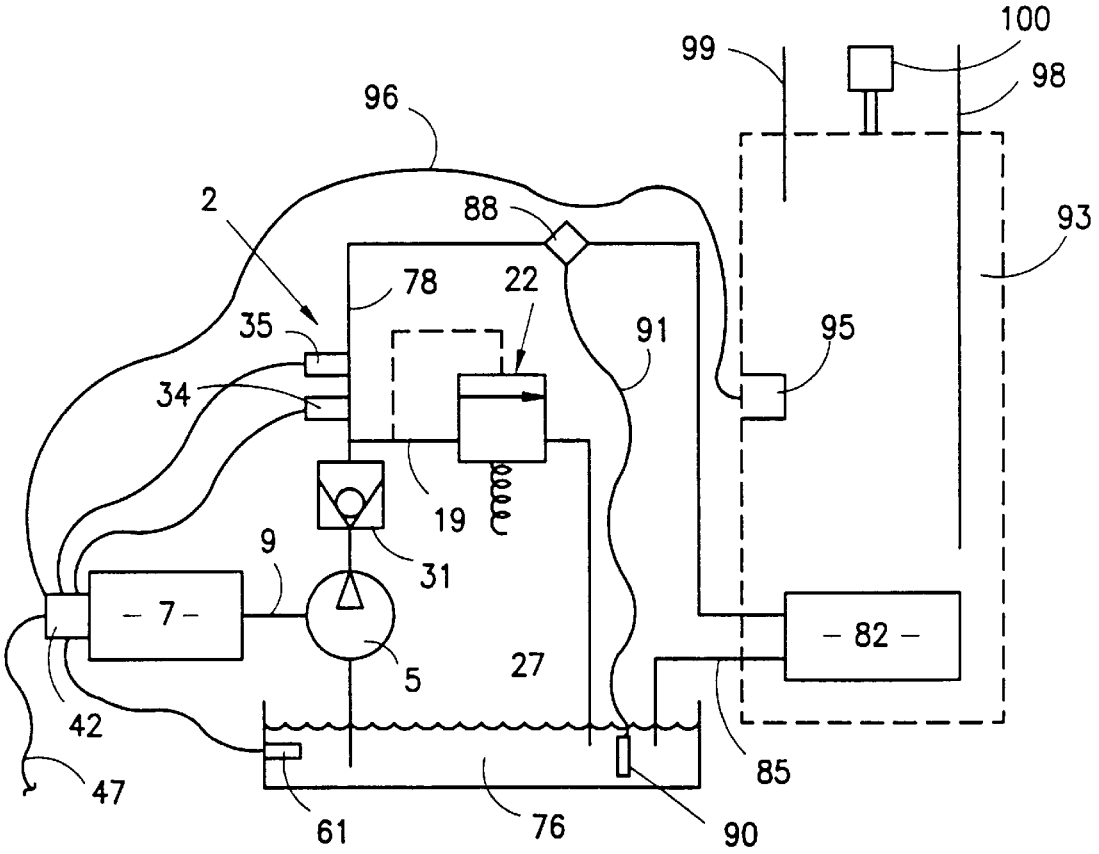
FIG. 3 is a schematic of the heating apparatus illustrated for use in a hot water heating system.

With initial reference to FIG. 1, the liquid heating apparatus of the invention is generally indicated at 2. Apparatus 2 includes a high pressure pump 5 that is adapted to be driven by an electric motor 7 through a shaft 9. Pump 5 includes an inlet port 11, connected to an inlet line 13 carrying a first connector 15, and an outlet port 17 connected to a liquid passage 19.

Downstream of pump 5, passage 19 leads to a unit that is adapted to retain a liquid delivered into passage 19 by pump 5 until the temperature and pressure of the liquid are raised desired amounts. In the embodiment depicted in this figure, this retaining unit is constituted by a pressure relief valve 22 which is fluidly connected to an output line 27 having a second connector 29, however, other types of valving arrangements including needle valve, orifices or other types of flow restricting valves, as well as other types of units that would perform the desired retaining function such as a fluid motor, could also be utilized. Since the particular structure of pressure relief valve 22 is known in the art, it will not be detailed herein. Although the full operation of apparatus 2 will be detailed below, at this point it is important to note that valve 22 will prevent a liquid drawn through pump 5 into passage 19 from exiting passage 19 until the liquid has been heated by frictional forces acting on the liquid by means the operation of pump 5 and the presence of valve 22.

In accordance with the invention, valve 22 is pre-set to a predetermined relief pressure or flow restricting degree depending on the particular use of apparatus 2 and the specific liquid utilized therewith. The apparatus 2 of FIG. 1 is particularly adapted for use as an in-line water heater, either as a portable unit wherein first and second connectors 15 and 29 are adapted to be readily connected to standard garden hoses or as a home hot water supplying arrangement. In either case, the water connected to inlet line 13 will typically be at approximately 20 psi and about 50° F. Knowing these parameters and the desired output temperature of the liquid will enable the size of pump 5 and the preset pressure relief level to be selected. For example, for home water heating wherein a maximum output temperature for the liquid of approximately 140° F. is desired, pump 5 will operate at a rate corresponding to pumping approximately 8 gallons per minute and valve 22 is set at approximately 1500 psi and will allow a continuous output flow of heated water at the rate of approximately 2 gallons per minute at 20 psi. Of course, these test numbers are presented for exemplary purposes only and the actual pumping rate, the set pressure relief level, output temperature and output flow rate can be readily determined experimentally.

In addition to the structure discussed above, preferably interposed between pump 5 and valve 22 is a check valve 31 which prevents back pressure on pump 5, particularly after motor 7 de-activated, so as to unload the pump 5 and motor 7. In addition, to provide automatic control and for safety reasons, one or more sensors 34–36 is provided and signal, through respective lines 38–40, a relay switching unit 42 for controlling the de-activation of motor 7. When apparatus 2 is used as a portable water heater, relay switching unit 42 is connected through an electrical line 44 to an ON/OFF switch 45 that is also connected to a power cord 47 having a plug 48. The entire heater structure can be located within a portable housing 50.

As indicated above, sensors 34–36 are provided for safety reasons and, more specifically, to prevent the possibility of the liquid from being heated or pressurized to a dangerous level due to a potential malfunction of one of the components of heating apparatus 2. In the preferred embodiment shown, sensor 34 constitutes a pressure sensor, sensor 35 constitutes a temperature sensor and sensor 36 constitutes a temperature sensor. In any event, various types of sensors can be utilized and only one such sensor need be provided, preferably either pressure sensor 34 or temperature sensor 35, for safety reasons, with other sensors merely providing an added level of safety. The heating apparatus 2 of FIG. 1 has been found to continuously provide a supply of heated water with a greatly reduced power consumption rate over known hot water heaters. In addition, heating apparatus 2 is extremely compact and lightweight so that it is readily portable.

FIGS. 2–8 illustrate other exemplary uses for heating apparatus 2 as will be discussed below. Since the heating apparatus 2 can be used in many environments with little or no change in its structure or function, like reference numerals will be used to represent corresponding structure to that described above and therefore this corresponding structure will not be reiterated.

FIG. 2 illustrates heating apparatus 2 used in a boiler for generating a supply of steam. In this embodiment, a tank 53 defines a closed chamber that is filled with a liquid medium to a level 56 so as to define a reservoir 58. The apparatus 2 functions as described above to heat the liquid to a predetermined temperature that is greater than the boiling point of water and measured by a thermo-sensor 61 which sends a signal to relay switching unit 42 to de-activate motor 7 when this temperature is reached in reservoir 58. A water inlet line 64 extends into tank 53 through an inlet port 65 and a one-way check valve 66. A steam outlet line 69 extends from an outlet port 70 of tank 53.

In the preferred embodiment of FIG. 2, the liquid medium that is heated constitutes water, however, it is easily possible to utilize other liquids such as hydraulic fluid or an ammonia based liquid and to simply arranged this heated liquid in heat exchange relationship with the incoming water entering tank 53 through inlet line 64 in order to generate the desired steam.

FIG. 3 illustrates an embodiment wherein the heating apparatus 2 is used as the heat source for a conventional hot water heater. In this embodiment, a reservoir 76 of fluid, preferably hydraulic fluid, is provided through which pump 5 draws the liquid medium to be heated. Here, liquid passage 19 is fluidly connected to a liquid conduit 78 that leads to a heat exchanger 82. Heat exchanger 82 also has associated therewith a return conduit 85 that leads back to the reservoir 76. In the preferred embodiment shown, located in liquid conduit 78 is an solenoid valve 88 which is connected to a thermocouple 90 located in reservoir 76 through a signal line 91.

Heat exchanger 82 is positioned in a hot water tank 93 and is therefore in heat exchange relationship with water placed in the hot water tank 93. A temperature sensor 95 is also positioned in hot water tank 93 and is connected through a line 96 to relay switching unit 42. The water for hot water tank 93 is provided via an inlet line 98 and the flow of water from hot water tank 93 is taken through outlet line 99. Also shown at 100 is a pressure relief for the hot water tank 93.

The manner of operation of the system depicted in the embodiment of FIG. 3 will now be described. The system is designed to be operate automatically and to be an alternative to a conventional hot water heater. The supply of water into and out of hot water tank 93 is as conventionally known and therefore need not be described. When temperature sensor 95 indicates that the water in tank 93 needs to be heated (which temperature is generally adjustable), a signal is sent through line 96 to relay switching unit 42 in order to activate motor 7 and pump 5. At the same time, thermocouple 90 will sense the temperature of the liquid medium in reservoir 76. If the temperature signaled by thermocouple 90 is above a prescribed limit needed to sufficiently heat the water in tank 93 (generally in the order of 160° F.), solenoid valve 88 will open liquid conduit 78 and the pumped liquid medium will flow to the heat exchanger 82 to heat the water in tank 93 as desired. Preferably, a fraction of the pumped liquid will still flow through liquid passage 19 to be further heated as well.

If the temperature in reservoir 76 is below the prescribed temperature, solenoid valve 88 will remain closed and all the liquid pumped will have to flow through liquid passage 19 and therefore will be heated in the manner described above. This recirculation process will then continue until the temperature in the reservoir 76 is high enough to open solenoid valve 88. If the temperature in reservoir gets dangerously high as sensed by thermosensor 61, motor 7 will be de-activated as described above with respect to the FIG. 2 embodiment. In addition, sensors 34 and 35 are shown here, while sensor 36 has not been shown for simplicity of the drawing.

Figure 4:
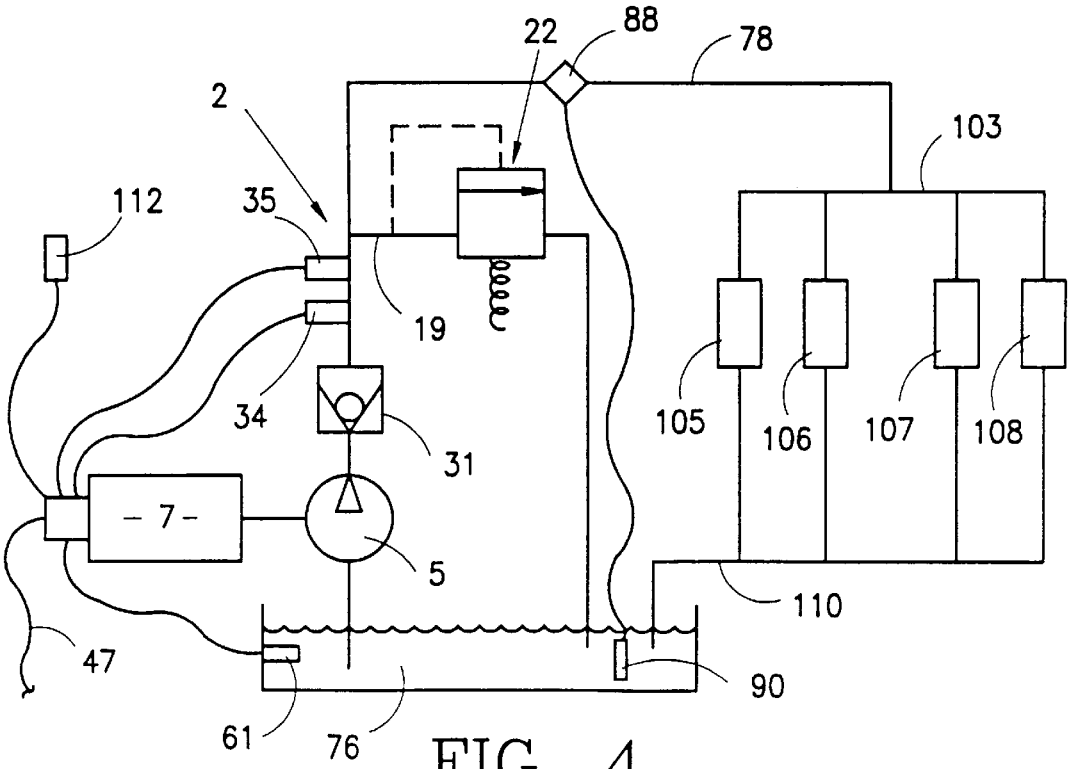
FIG. 4 is a schematic of the heating apparatus illustrated for use in a radiant heating system.

The embodiment of FIG. 4 represents utilizing the heating apparatus 2 in a radiant heating system. The heating apparatus 2 is arranged and works essentially the same in this embodiment as that described above with respect to the FIG. 3 embodiment, except as mentioned below. Liquid conduit 78 flows into a branch line 103 that lead through sub-conduits (not labeled) to a plurality of radiant heat exchangers 105–108 arranged in parallel. Each heat exchanger 105–108 leads to a common return line 110 to deliver the liquid medium back to the reservoir 76. In addition, no corresponding temperature sensor to sensor 95 is utilized here. Instead, motor 7 is controlled during normal operation depending on the setting of a thermostat such as that indicated at 112 which, of course, still senses an operating parameter which is, at least indirectly, related to the raised pressure and/or temperature of the liquid medium.

In this embodiment, when the temperature in a heating zone such as a area in a home is below a desired temperature set at thermostat 112, motor 7 will kick on. Pump 7 will then recirculate the liquid medium to the reservoir 76 until the same is heated to a predetermined temperature. Once this temperature is reached, solenoid valve 88 will open liquid conduit 78 and the heated liquid medium can readily flow to the heat exchangers 105–108 which essentially constitute radiators arranged throughout the heating zone. In all other aspects, the heating apparatus of FIG. 4 functions as previously described.

Figure 5:
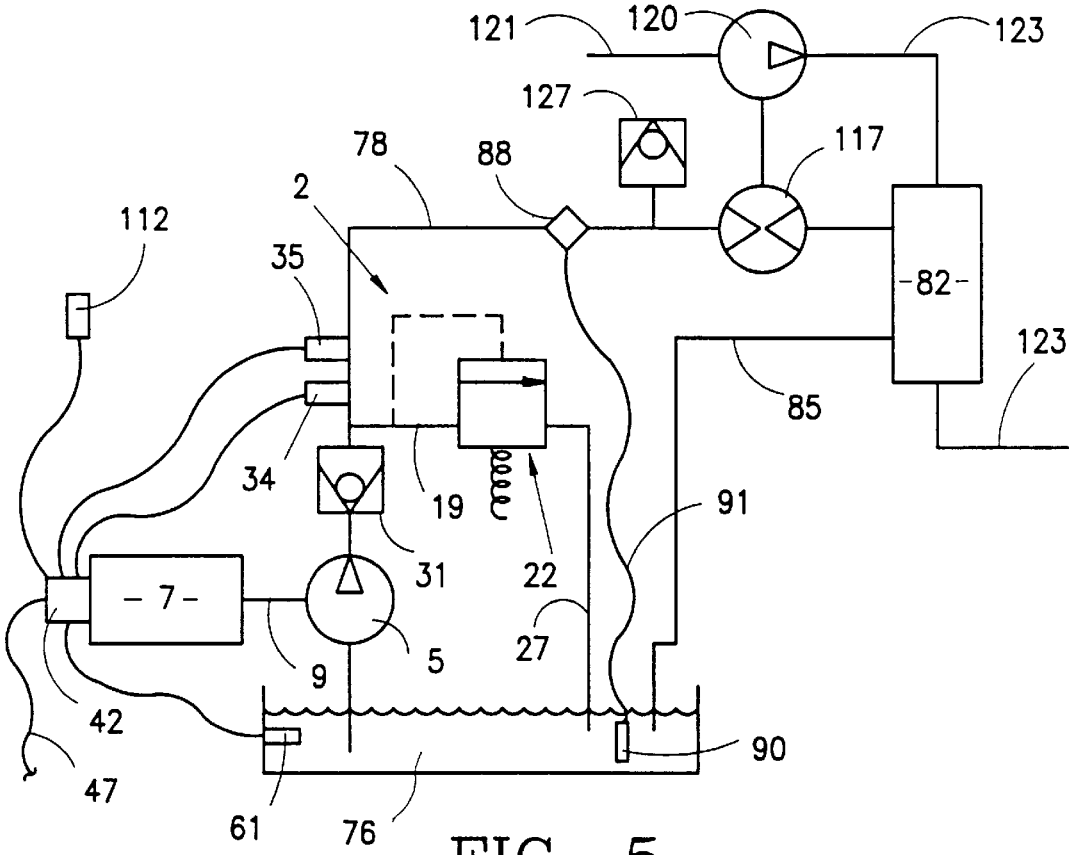
FIG. 5 is a schematic of the heating apparatus illustrated for use in heating pool water.

The embodiment of FIG. 5 is presented to illustrate the use of heating apparatus 2 in a pool, spa or the like water heating environment. Again heating apparatus 2 essentially works in the same manner as that described above, but located downstream of solenoid valve 88 and before heat exchanger 82 is a fluid motor 117. Since the liquid medium used is preferably an hydraulic fluid, motor 117 constitutes an hydraulic motor of preferably fixed displacement. Fluid motor 117 is driven when the liquid medium is sent through liquid conduit 78 upon the opening of valve 88. Here, however, thermostat 112 is adjusted to set a desired water temperature for the pool, spa or the like.

Fluid motor 117 is drivingly connected to a water pump 120 having an associated inlet line 121 and a water outlet line 123 with the water outlet line 123 being in heat transfer relationship with heat exchanger 82 for heating of the water flowing therethrough. Again, operation of the heating apparatus 2 in accordance with this embodiment will not be reiterated here given the detailed description provided above and the clearly analogous structure and function. It should be noted, however, that liquid conduit 78 is provided with an anti-cavitation device in the form of a check valve 127 which opens the inlet to fluid motor 117 to either atmosphere (as shown) or reservoir 76 when there is no pressure in the line due to the closing of solenoid valve 88. This structure is provided to simply provide a more quite operation as fluid motor 117 runs down due to built-up momentum following the closing of solenoid valve 88 and commensurate loss of driving fluid for fluid motor 117. Finally, it should be readily apparent that thermostat 112 could operate on a timer basis without affecting the overall operation of the invention and solenoid valve 88 could be opened, either fully or partially, and motor 7 could be readily controlled to operate in a non-heating mode to simply circulate the pool water, such as by providing a valve at the juncture of liquid passage 19 and liquid conduit 78 to prevent flow through passage 19 or by providing a valve which would enable the flow through water outlet line 123 to bypass heat exchanger 82.

Figure 6:
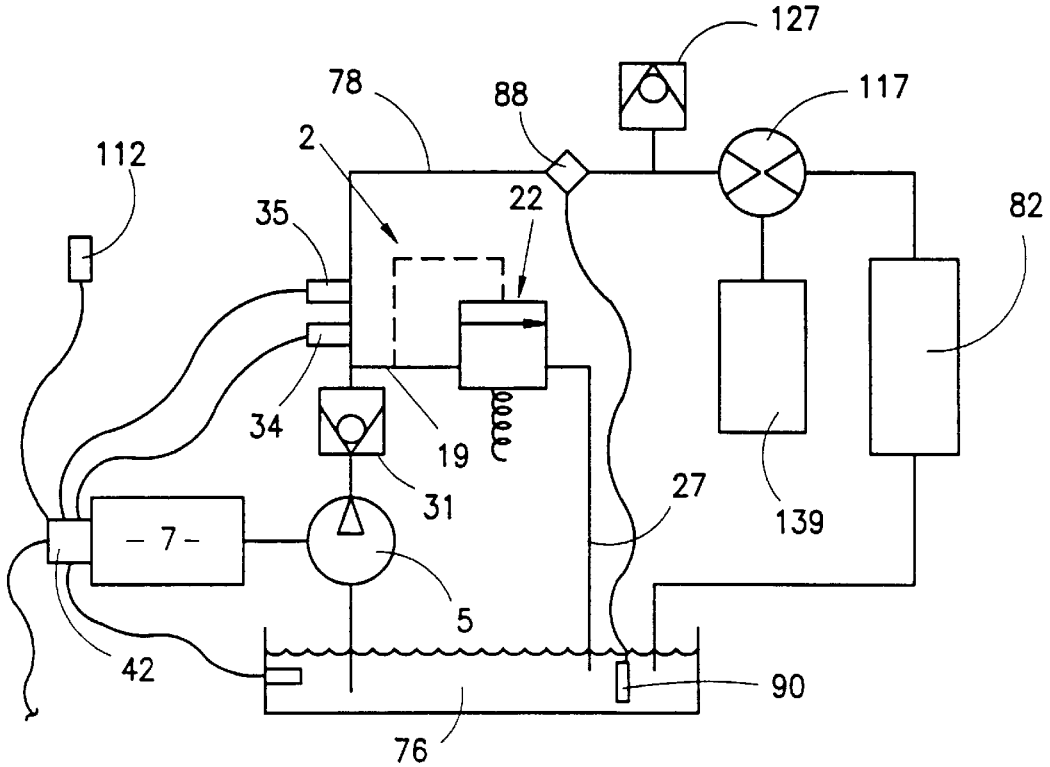
FIG. 6 is a schematic of the heating apparatus according to a sixth embodiment wherein the heating apparatus forms part of an air heating arrangement.

The embodiment of FIG. 6 is almost identical to the arrangement described above with reference to FIG. 5 except that fluid motor 117 drives a blower 139 that directs a flow of air over heat exchanger 82 such that a forced air heating system is provided. In initial testing of a heating apparatus 2 constructed in accordance with this embodiment, it has been found that a conventional forced air heating system incorporating a resistance heating element can be replaced in accordance with the present invention and operated at well below, i.e. approximately half, the cost associated with operating the conventional system. Again, this arrangement could also readily be used for simply driving blower 139 in a fan or air circulating mode.

As mentioned above, FIG. 7 illustrates the heating apparatus 2 of the present invention incorporated in a clothes dryer. In accordance with this embodiment, a flow divider 152 is provided in liquid conduit 78 downstream of solenoid valve 88 to divide liquid conduit 78 into sub-conduits 154 and 155. Sub-conduit 154 leads to a second fluid motor 157 which is adapted to drive a rotary drum 158 of the clothes dryer. Sub-conduit 155 leads to a fluid motor 117 which drives blower 139. Blower 139 functions in this embodiment to direct a flow of heated air into rotary drum 158 commensurate with the operation of known clothes drying units. Finally, in this embodiment, the thermostat of the above-described embodiments is replaced with a timer unit 160 provided on a conventional clothes dryer control panel. Again, the operation of the heating apparatus 2 in accordance with this embodiment is the same as that described above given the like reference numerals which refer to corresponding parts in the several embodiments and therefore the operation will not be further described here.

Finally, FIG. 8 is presented to illustrate some additional aspects of the present invention. In accordance with the embodiment of FIG. 8, motor 7 directly drives a first pump 172 through a first shaft 173. In turn, first pump 172 provides a flow of fluid to drive a first motor 175 through a first line 177 and first motor 175 has an output shaft 179 which drives a second pump 181. Second pump 181 is interconnected through a second line 183 to a second motor 185 which has associated therewith a third output shaft 187 that drives a third pump 189. Third pump 189 has an output that leads into a passage 192. As clearly shown in this Figure, each of first, second and third pumps 172, 181 and 189, as well as first and second motors 175 and 185, are submerged within a reservoir 195 into which fluid, preferably hydraulic fluid, can be filled at fill port 196 which also preferably functions to vent reservoir 195. With this arrangement, first pump 172 can draw fluid from within reservoir 195 and the output is delivered to passage 192. Since these various components are submerged within reservoir 195, the heat generated by the operation of these components merely advantageously adds to the heating of the fluid within reservoir 195. Although this arrangement is shown in the embodiment of FIG. 5, it should be readily understood that such a multiple pump and motor drive combination that is submerged within a reservoir can be readily incorporated in the various embodiments described above, particularly the embodiments of FIGS. 2 and 6.

In accordance with another aspect of the invention, it should be noted that the embodiment of FIG. 8 does not include a bypass loop similar to that in many of the embodiments described above which can be used for initial preheating of the fluid medium. Therefore, FIG. 8 exemplifies that such a preheating bypass loop is not mandatory in connection with the present invention but the actual operation of the unit can progressively heat the fluid in the reservoir. In addition, a heating element, electric or otherwise as generically indicated at 197, could be provided within reservoir 195 to preheat the fluid or to maintain the fluid in reservoir 195 at a minimal desired temperature. Heating element 197, although not particularly illustrated in this Figure, could be connected to a temperature relay for automatically controlling this desired fluid temperature.

The embodiment of FIG. 8 is further intended to illustrate the applicability of the present invention to drive various components and function in a heat pump-type heating environment. To this end, passage 192 includes a first branch line 201 leading to a first drive motor 204 that is connected to a blower 207 through a first driveshaft 210. First drive motor 204 is also connected to a first return line 213 that dumps fluid, reduced in pressure and increased in temperature, back to reservoir 195. Passage 192 also has associated therewith a second branch line 216 that leads to a second drive motor 218. In this embodiment, second drive motor 218 is connected to a compressor 221 through a second driveshaft 223 and has associated therewith a second return line 224 leading to reservoir 195.

Compressor 221 forms part of a circuit generally indicated at 226 that also includes first and second heat exchangers 229 and 232. In the preferred embodiment, heat exchanger 229 actually constitutes an evaporator that is submerged within the fluid of reservoir 195 and heat exchanger 232 constitutes a condenser. Evaporator 229 is connected to compressor 221 through a first flow line 235, compressor 221 is fluidly connected to condenser 232 by a second flow line 237 and condenser 232 is connected to evaporator 229 through a third flow line 239.

From the above description and illustration, is should be readily apparent that circuit 226 illustrates a general circuit associated with a heat pump. However, instead of having the evaporator draw heat from the ambient air to expand a fluid medium provided within the circuit and delivered to compressor 221, evaporator 229 will receive heat from the fluid within the reservoir 195. In this sense, the embodiment of FIG. 8 attempts to simulate a geothermal heat pump system in that the fluid medium within reservoir 195 is not adversely affected by ambient atmosphere such that this system does not have the associate disadvantages of current heat pumps but rather can be used in much colder environments. In any event, it has been found that the multiple pumps and motor combinations within reservoir 195 generates a substantial amount of heat and that first and second drive motors 204 and 218 will perform a retaining function similar to that of pressure relief valve 22, especially considering the back pressure that is generated due to the presence of drive blower 207 and compressor 221. Therefore, passage 192 and first and second branch lines 201 and 216 will have associated fluid pressures greater than at least fifteen times the pressure within the reservoir 195 in order to generate a sufficient amount of heat. of course, operation of first and second drive motors 204 and 218, which are needed to heat the fluid medium in reservoir 195, also perform mechanical work by driving blower 207 and compressor 221 and therefore operating circuit 226. With blower 207 being arranged adjacent condenser 232, the generated air flow will be heated and then can be directed to a desired zone, such as throughout a residential house, for heating purposes.

From the above description of numerous embodiments of the invention, it should be readily apparent that the heating apparatus 2 of the present invention is versatile and can readily supply a heated fluid which can be used for various purposes either directly or as a medium for heating another fluid. In addition, supplemental fluid motors could be readily incorporated to drive other auxiliary components such as, for example, a generator, an exhaust fan or the like. Furthermore, the heating apparatus is extremely compact and energy efficient. However, although described with respect to preferred embodiments of the invention, it should be readily understood that various changes and/or modifications may be made to the invention without departing from the spirit thereof. In general, the invention is only intended to be limited by the scope of the following claims.

I claim:

1. An apparatus for heating a liquid medium comprising:

a liquid passage;

means for drawing a liquid medium into said liquid passage at a first pressure and a first temperature;

means for retaining said liquid medium in said liquid passage until said liquid medium is pressurized to a second pressure which is multiple times higher than said first pressure and frictionally heated to a second temperature which is greater than said first temperature;

means for releasing said liquid medium in a heated state from said liquid passage at a third pressure which is lower than said second pressure;

means for sensing an operating parameter related to at least one of the second temperature and the second pressure of said liquid medium;

means for automatically controlling the operation of said drawing means based on the sensed operating parameter;

a reservoir from which said drawing means receives said liquid medium;

a closed circuit heating system including a first heat exchanger, a compressor and a second heat exchanger;

a blower unit positioned adjacent said second heat exchanger; and means for driving said compressor and said blower unit, said driving means including at least one fluid motor adapted to receive a supply of said liquid medium from said drawing means.

2. The apparatus according to claim 1, wherein said first heat exchanger is located in said reservoir.

3. The apparatus according to claim 2, further comprising: a return line for delivering the supply of said liquid medium from said at least one fluid motor back to the reservoir, said return line directing the supply of said liquid medium towards said first heat exchanger.

4. The apparatus according to claim 1, wherein said drawing means comprises a first pump for drawing the liquid medium from the reservoir, a first drive motor fluidly interconnected to and driven from an output flow from the first pump, and a second pump drivingly connected to the first drive motor.

5. The apparatus according to claim 4, wherein each of the first pump, the first drive motor and the second pump are located in said reservoir.

6. An apparatus for heating a liquid medium comprising:

a liquid passage;

means for drawing a liquid medium into said liquid passage at a first pressure and a first temperature;

means for retaining said liquid medium in said liquid passage until said liquid medium is pressurized to a second pressure which is multiple times higher than said first pressure and frictionally heated to a second temperature which is greater than said first temperature;

means for releasing said liquid medium in a heated state from said liquid passage at a third pressure which is lower than said second pressure;

means for sensing an operating parameter related to at least one of the second temperature and the second pressure of said liquid medium;

means for automatically controlling the operation of said drawing means based on the sensed operating parameter;

a reservoir from which said drawing means receives said liquid medium;

a first pump located in said reservoir, and a fluid motor located in said reservoir and fluidly connected to said first pump, said drawing means being drivingly connected to said fluid motor.

7. The apparatus according to claim 6, wherein said drawing means includes at least a second pump.

8. The apparatus according to claim 7, wherein the second pump is submerged within the reservoir.

9. The apparatus according to claim 6, further comprising: a second fluid motor located outside of the reservoir, said second fluid motor being adapted to receive a supply of said liquid medium for driving said second fluid motor.

10. A method of generating and exchanging heat comprising:

sensing a desired heating condition for a zone;

drawing a liquid from a reservoir by means of a motor driven pump;

frictionally heating and raising the pressure of said liquid;

driving a fluid motor by said liquid and utilizing the fluid motor to cause a fluid to flow in heat exchange relationship with the liquid;

directing the fluid into said zone; and sensing when the desired heating condition for the zone is reached and then de-activating the motor driven pump.

11. The method according to claim 10, wherein the fluid is constituted by water.

12. The method according to claim 10, wherein the fluid is constituted by air.

13. A portable apparatus for heating a liquid medium comprising:

a liquid passage having an inlet and an outlet, at least said inlet being provided with a threaded connector adapted to be attached to a standard garden hose;

a pump for drawing a liquid medium into said liquid passage, through said inlet, at a first pressure and a first temperature;

a flow controlling device in fluid communication with the liquid passage between the pump and the outlet, said flow controlling device retaining said liquid medium in said liquid passage until said liquid medium is pressurized to a second pressure which is multiple times higher than said first pressure and frictionally heated to a second temperature which is greater than said first temperature and releasing said liquid medium into the liquid passage downstream of the flow controlling device, with said liquid medium being delivered to said outlet in a heated state and at a third pressure which is lower than said second pressure.

14. The apparatus according to claim 13, further comprising:

means for sensing an operating parameter of said liquid medium downstream of said pump; and means for automatically controlling the operation of at least one of said pump and said flow controlling device based on the sensed operating parameter.

15. The apparatus according to claim 13, further comprising:

a check valve arranged between said pump and said flow controlling device.

16. The apparatus according to claim 13, wherein said flow controlling device comprises a pressure relief valve.

* * * * *